US010060325B2

(12) United States Patent
Nagai et al.

(10) Patent No.: US 10,060,325 B2
(45) Date of Patent: Aug. 28, 2018

(54) CYLINDER HEAD COOLING APPARATUS OF ENGINE

(71) Applicant: KUBOTA Corporation, Osaka-shi, Osaka (JP)

(72) Inventors: Kentaro Nagai, Sakai (JP); Hiroshi Kuwasaki, Sakai (JP); Tadashi Nakano, Sakai (JP); Takahito Hamasaki, Sakai (JP); Yoshinori Tanaka, Sakai (JP); Masaya Mori, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 131 days.

(21) Appl. No.: 14/842,988

(22) Filed: Sep. 2, 2015

(65) Prior Publication Data

US 2016/0102595 A1 Apr. 14, 2016

(30) Foreign Application Priority Data

Oct. 10, 2014 (JP) ..... 2014-208598

(51) Int. Cl.
*F01P 3/02* (2006.01)
*F02F 1/40* (2006.01)
(Continued)

(52) U.S. Cl.
CPC ..... *F01P 3/02* (2013.01); *F01P 11/04* (2013.01); *F02F 1/14* (2013.01); *F02F 1/40* (2013.01);
(Continued)

(58) Field of Classification Search
CPC ..... F01P 3/02; F01P 11/04; F02F 1/40; F02M 35/04
See application file for complete search history.

(56) References Cited

U.S. PATENT DOCUMENTS 3,420,215 A * 1/1969 Seifert ..... F01L 1/26 123/268
3,769,948 A * 11/1973 Feichtinger ..... F02F 1/40 123/188.14
2001/0035138 A1* 11/2001 Fukamachi ..... F01P 7/16 123/41.1

FOREIGN PATENT DOCUMENTS

CH 680938 A5 12/1992
DE 4116943 C1 6/1992
(Continued)

OTHER PUBLICATIONS

Extended Search Report dated Feb. 22, 2016 in EP Application No. 15183568.3.
(Continued)

*Primary Examiner* — Kevin A Lathers
(74) *Attorney, Agent, or Firm* — Panitch Schwarze Belisario & Nadel LLP

(57) ABSTRACT

There is provided a cylinder head cooling apparatus of an engine capable of enhancing cooling efficiency around an auxiliary combustion chamber wall. The cylinder head cooling apparatus of an engine including a cylinder head having therein an intake port, an exhaust port, an auxiliary combustion chamber, and a cooling water jacket, in which an intake port wall, an exhaust port wall, and an auxiliary combustion chamber wall are placed in the cooling water jacket, the cooling water jacket includes a cooling water inlet and a cooling water outlet, engine cooling water flowed from the cooling water inlet into the cooling water jacket flows out from the cooling water outlet through the cooling water jacket, wherein a cooling water guide wall is provided upstream of the auxiliary combustion chamber wall in a cooling water passing path of the cooling water jacket, and the upstream cooling water guide wall is formed into a shape whose width gradually widens toward a downstream side.

6 Claims, 8 Drawing Sheets

(51) Int. Cl.

| | |
|---|---|
| ***F01P 11/04*** | (2006.01) |
| ***F02F 1/14*** | (2006.01) |
| ***F02F 1/42*** | (2006.01) |
| ***F02M 35/10*** | (2006.01) |
| ***F02M 35/104*** | (2006.01) |

(52) U.S. Cl.
CPC ..... *F02F 1/4285* (2013.01); *F02M 35/104* (2013.01); *F02M 35/10091* (2013.01); *F01P 2003/021* (2013.01); *F01P 2003/024* (2013.01)

(56) References Cited

FOREIGN PATENT DOCUMENTS

| | | | |
|---|---|---|---|
| JP | S56041138 | B2 | 9/1981 |
| JP | S5748 | U | 1/1982 |
| JP | H06-040336 | U | 5/1994 |
| JP | H06221149 | A | 8/1994 |
| JP | H0932630 | A | 2/1997 |
| JP | H09324695 | A | 12/1997 |
| JP | 3668650 | B2 * | 7/2005 |

OTHER PUBLICATIONS

Office Action dated Sep. 26, 2017 in JP Application No. 2014-208598.

* cited by examiner

CYLINDER HEAD COOLING APPARATUS OF ENGINE

BACKGROUND OF THE INVENTION (1) Field of the Invention

The present invention relates to a cylinder head cooling apparatus of an engine.

(2) Description of Related Art

Conventionally, as a cylinder head cooling apparatus of an engine, there is an apparatus in which engine cooling water passing through a cooling water jacket is caused to flow along a cylindrical auxiliary combustion chamber wall.

In the conventional cylinder head cooling apparatus of an engine, engine cooling water does not easily divert toward both sides of the auxiliary combustion chamber wall smoothly, and cooling efficiency around the auxiliary combustion chamber wall is low.

SUMMARY OF THE INVENTION

An object of the present invention is to provide a cylinder head cooling apparatus of an engine capable of enhancing cooling efficiency around the auxiliary combustion chamber wall.

A matter to define the present invention is as follows.

A cylinder head cooling apparatus of an engine includes a cylinder head having therein an intake port, an exhaust port, an auxiliary combustion chamber, and a cooling water jacket, in which an intake port wall, an exhaust port wall and an auxiliary combustion chamber wall are placed in the cooling water jacket, the cooling water jacket includes a cooling water inlet and a cooling water outlet, engine cooling water flowed from the cooling water inlet into the cooling water jacket flows out from the cooling water outlet through the cooling water jacket, wherein a cooling water guide wall is provided upstream of the auxiliary combustion chamber wall in a cooling water passing path of the cooling water jacket, and the upstream cooling water guide wall is formed into a shape whose width gradually widens toward a downstream side.

The present invention has the following effects.

The engine cooling water flowing upstream of the auxiliary combustion chamber wall is guided by the upstream cooling water guide wall, and smoothly diverts toward both sides of the auxiliary combustion chamber wall, so that it is possible to enhance the cooling efficiency around the auxiliary combustion chamber wall.

Engine cooling water flowing upstream of the auxiliary combustion chamber wall collides against the upstream cooling water guide wall, and the auxiliary combustion chamber wall does not take a direct hit of the engine cooling water. Thus, excessive cooling of the auxiliary combustion chamber wall is suppressed, and it is possible to enhance the heat efficiency of the engine and the starting performance of the engine during a cold period.

DETAILED DESCRIPTION OF PREFERRED EMBODIMENT

FIGS. 1 to 8 are views for describing a cooling apparatus of a cylinder head of an engine according to an embodiment of the present invention. In this embodiment, the cooling apparatus of the cylinder head of a water-cooling vertical type two-cylinder diesel engine will be described.

An outline of the cylinder head of the engine is as follows.

Figure 3:
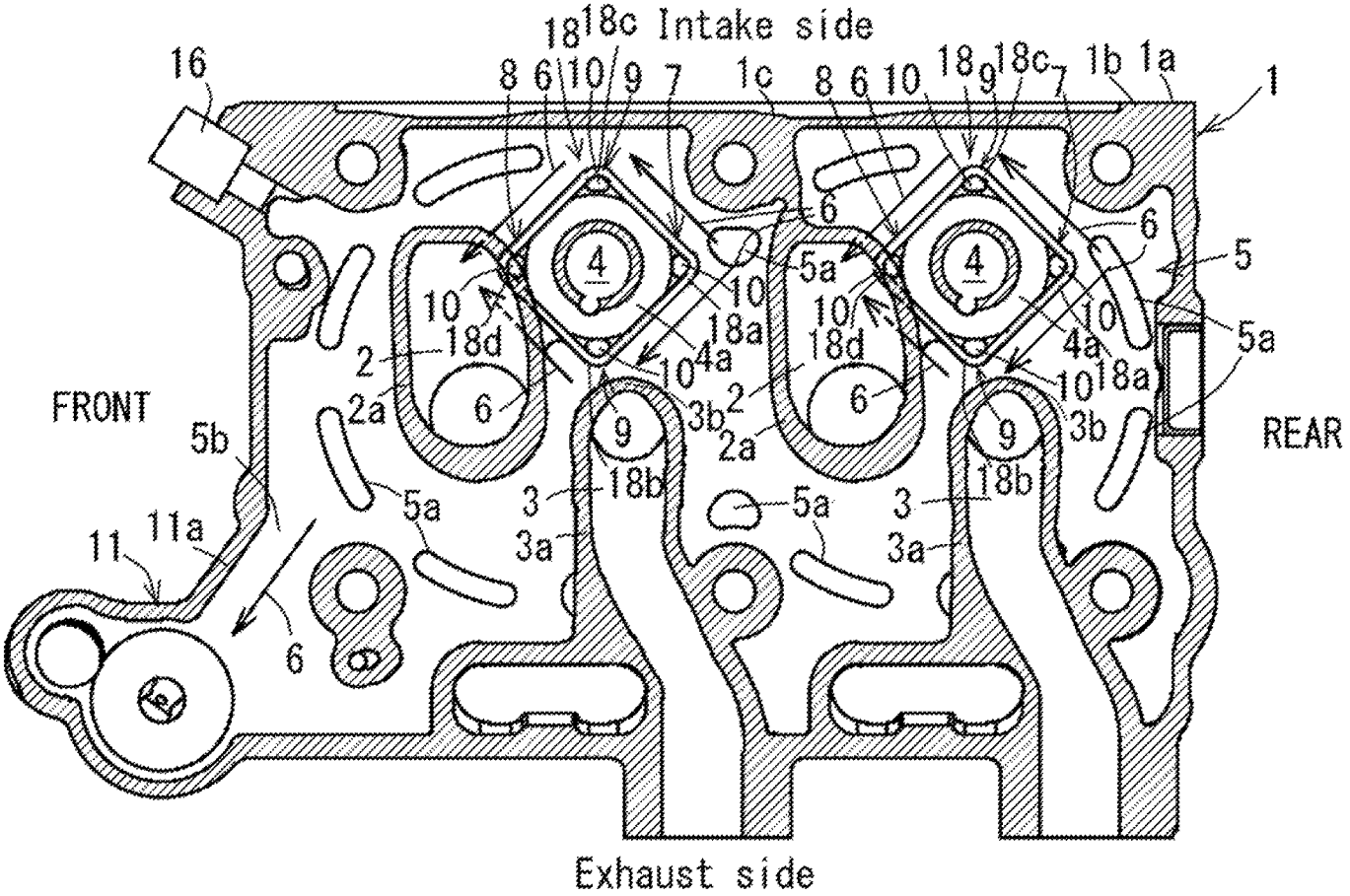
FIG. 3 is a sectional view taken along line III-III in FIG. 2.
Figure 4:
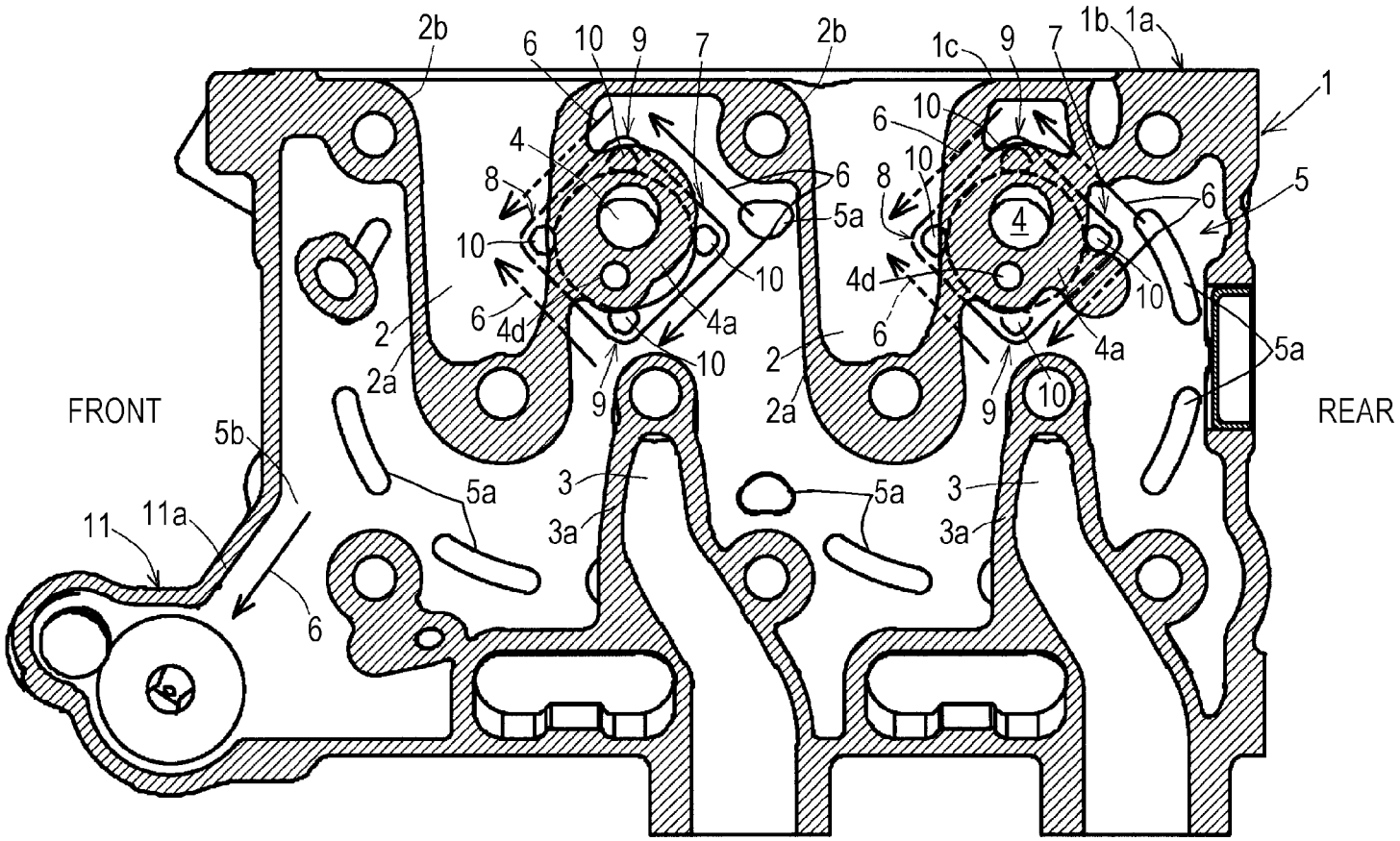
FIG. 4 is a sectional view taken along line IV-IV in FIG. 2.
Figure 5:
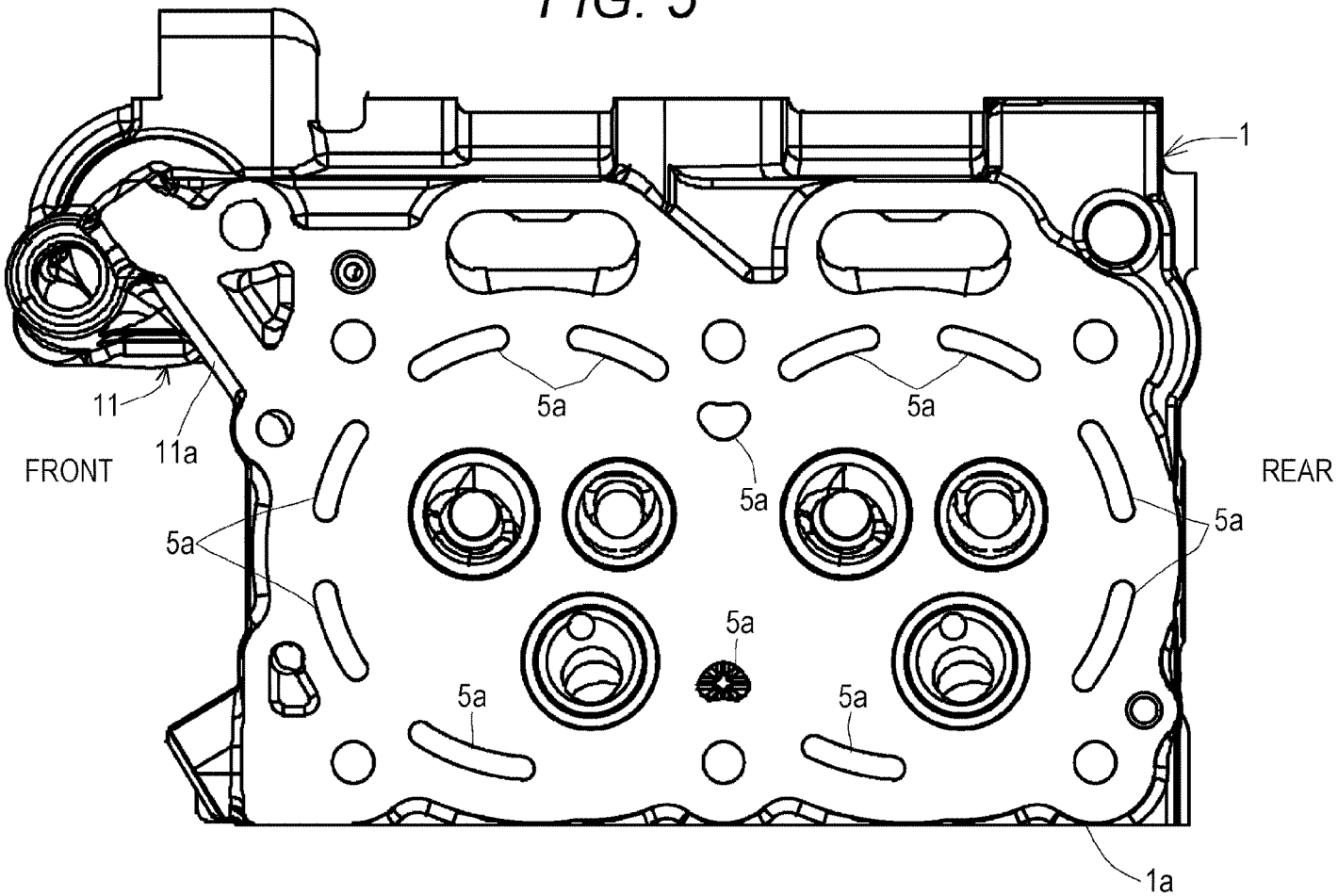
FIG. 5 is a bottom view of the cylinder head shown in FIG. 1.
Figure 6:
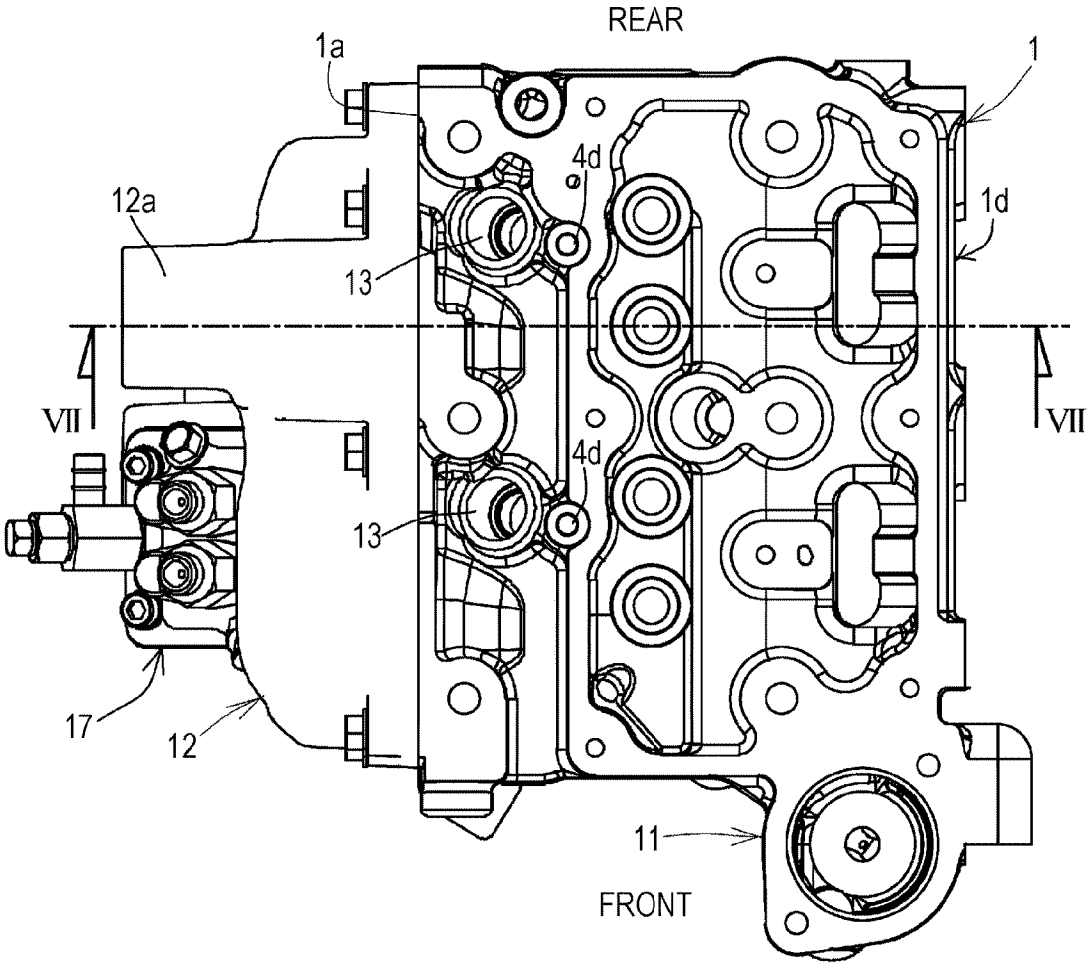
FIG. 6 is a plan view of the cylinder head on which an intake manifold in FIG. 1 is mounted, illustrating a positional relation between the intake manifold and a fuel injection pump.

As shown in FIG. 6, an intake manifold (12) is mounted on one (1*a*) of lateral walls of a cylinder head (1), and an exhaust manifold (not shown) is mounted on the other lateral wall (1*d*). As shown in FIGS. 3 and 4, an extending direction of a crankshaft (not shown) is defined as a longitudinal direction, a pair of front and rear intake ports (2), (2) and a pair of front and rear auxiliary combustion chambers (4), (4) are placed on a suction side in the cylinder head (1), and a pair of front and rear exhaust ports (3), (3) are placed on an discharge side in the cylinder head (1). A cooling water jacket (5) is provided in the cylinder head (1). The cylinder head (1) is low pressure cast in aluminum. A side where a later-described thermostat housing (11) exists is defined as a front side.

A configuration of the cooling apparatus of the cylinder head is as follows.

As shown in FIGS. 3 and 4, intake port walls (2*a*), exhaust port walls (3*a*), and auxiliary combustion chamber walls (4*a*) are placed in the cooling water jacket (5). The cooling water jacket (5) includes cooling water inlets (5*a*) and a cooling water outlet (5*b*). Engine cooling water (6) flowed from the cooling water inlet (5*a*) into the cooling water jacket (5) flows out from the cooling water outlet (5*b*) through the cooling water jacket (5).

As shown in FIGS. 3 and 4, the plurality of cooling water inlets (5*a*) of the cooling water jacket (5) are upwardly open from the cooling water jacket (not shown) on the cylinder side which surrounds the cylinder of a cylinder block, and engine cooling water (6) raised from the cooling water jacket on the cylinder side flows from the cooling water inlets (5*a*) into the cooling water jacket (5) of the cylinder head (1).

The cooling water outlet (5*b*) of the cooling water jacket (5) is open toward a discharge side located on the downstream side (front side) of the cooling water jacket (5).

As shown in FIGS. 3 and 4, cooling water guide walls (7) are provided upstream of the auxiliary combustion chamber walls (4*a*) in the cooling water passing path of the cooling water jacket (5). Each of the upstream cooling water guide walls (7) is formed into the shape of a letter L, a letter V, or a dogleg whose width gradually widens toward the downstream side.

Figure 1:
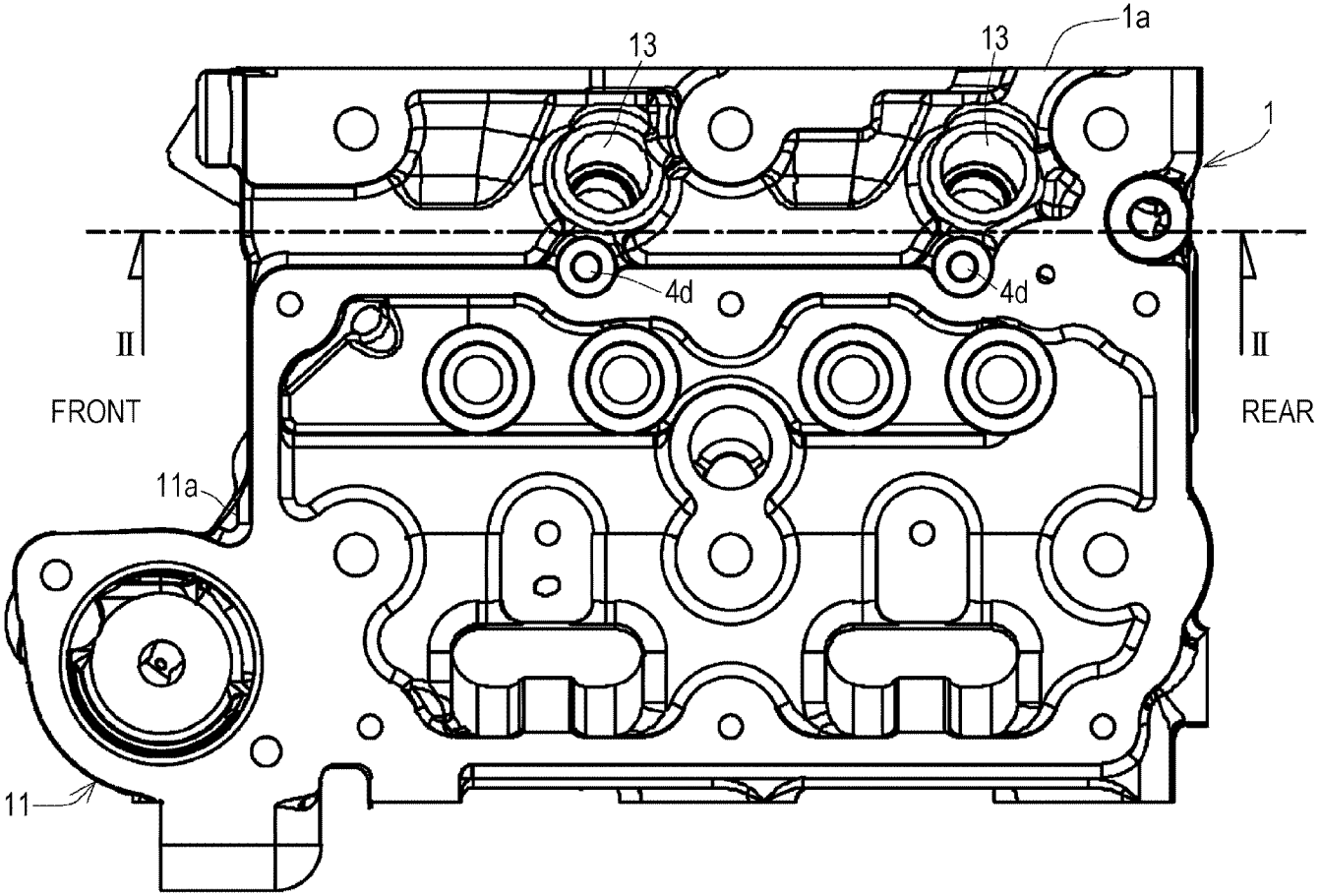
FIG. 1 is a plan view of a cylinder head of an engine according to an embodiment of the present invention.
Figure 2:
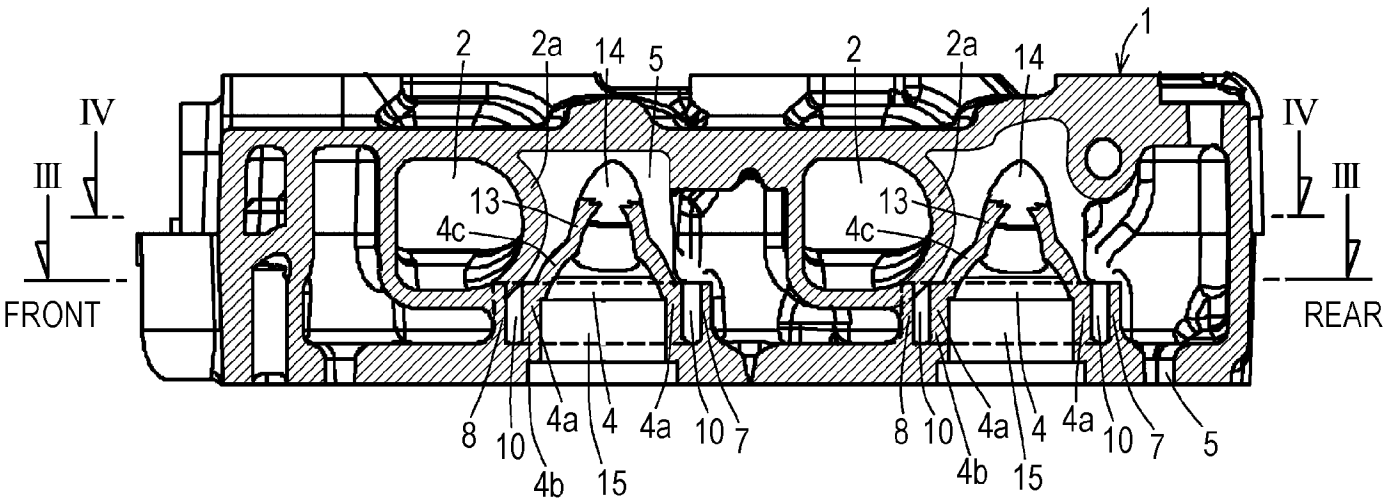
FIG. 2 is a sectional view taken along line II-II in FIG. 1.

As shown in FIG. 2, each of the auxiliary combustion chamber walls (4*a*) includes a cylindrical lower portion (4*b*) and a domical ceiling (4*c*), a cylindrical injector mounting boss (13) extends from the ceiling (4*c*), and a fuel injector (14) is mounted on the injector mounting boss (13). The auxiliary combustion chamber (4) is a vortex chamber. As shown in FIG. 4, a glow plug insertion hole (4*d*) is open from the ceiling (4*c*) of the auxiliary combustion chamber wall (4*a*).

As shown in FIG. 2, a mouth ring (15) is fitted into the lower portion (4*b*) of each of the auxiliary combustion chamber walls (4*a*), compressed air is introduced from a main combustion chamber (not shown) in the cylinder into the auxiliary combustion chamber (4) through an injection opening (not shown) of the mouth ring (15), fuel injected from the fuel injector (14) is previously mixed and burned in the auxiliary combustion chamber (4), and unburned fuel and air are injected from the injection opening into the main combustion chamber by the combustion pressure.

As shown in FIGS. 3 and 4, a cooling water guide wall (8) is provided downstream of each of the auxiliary combustion chamber walls (4*a*), and the downstream cooling water guide wall (8) is formed into the shape of a letter L, a letter V, or a dogleg whose width gradually narrows toward the downstream side.

Therefore, engine cooling water (6) flowing downstream of the auxiliary combustion chamber wall (4*a*) smoothly separates from the downstream cooling water guide wall (8), generation of wake flow on the downstream side of the auxiliary combustion chamber wall (4*a*) is suppressed, engine cooling water (6) in the cooling water jacket (5) smoothly flows, and the cooling efficiency of the cylinder head (1) can be enhanced.

As shown in FIGS. 3 and 4, cooling water guide walls (9), (9) are provided on both sides of each of the auxiliary combustion chamber walls (4*a*). Each of the both-side cooling water guide walls (9), (9) is formed into the shape of a letter L, a letter V, or a dogleg whose width gradually widens toward the downstream side and then gradually narrows toward the downstream side.

Therefore, engine cooling water (6) flowing on both sides of the auxiliary combustion chamber wall (4*a*) is guided by the both-side cooling water guide walls (9), (9), and smoothly diverts along the both sides of the auxiliary combustion chamber wall (4*a*), so that it is possible to enhance the cooling efficiency around the auxiliary combustion chamber wall (4*a*).

Further, engine cooling water (6) flowing along the both sides of the auxiliary combustion chamber wall (4*a*) smoothly separates from the cooling water guide walls (9), (9), generation of wake flow on downstream side of the auxiliary combustion chamber wall (4*a*) is suppressed, the engine cooling water (6) smoothly flows in the cooling water jacket (5), and the cooling efficiency of the cylinder head (1) can be enhanced.

Furthermore, the engine cooling water (6) flowing along the both sides of the auxiliary combustion chamber wall (4*a*) comes into contact with the both-side cooling water guide walls (9), (9), the auxiliary combustion chamber wall (4*a*) does not take a direct hit of the engine cooling water (6). Thus, excessive cooling of the auxiliary combustion chamber wall (4*a*) is suppressed, and it is possible to enhance the heat efficiency of the engine and the starting performance of the engine during a cold period.

As shown in FIGS. 3 and 4, exhaust port walls (3*a*) are placed on one of projection sides of the both-side cooling water guide walls (9), (9).

Therefore, engine cooling water (6) flowing along one side of the auxiliary combustion chamber wall (4*a*) is guided by the exhaust port wall (3*a*) at the one side cooling water guide wall (9). Thus, it is possible to enhance the cooling efficiency of the exhaust port wall (3*a*).

All of the cooling water guide walls (7), (8), (9), (9) are formed around the lower portion (4*b*) of the auxiliary combustion chamber wall (4*a*).

As may be seen in FIG. 3, both cooling water guide walls (7), (8), (9), (9) are assembled in a quadrilateral form as they surround the auxiliary combustion chamber wall (4*a*) so as to make a quadrilaterally-formed wall (18), with two quadrilaterally-formed walls (18) shown in FIG. 3. A diagonal of a quadrilateral of each quadrilaterally-formed wall (18), drawn between corners (18*a*) and (18*d*), is oriented in a direction along with the front-back direction, and a diagonal of a quadrilateral of the quadrilaterally-formed wall (18), drawn between corners (18*b*) and (18*c*), is oriented in a direction along with the right-left direction (lateral direction). Out of the quadrilaterally-formed wall (18), a backward corner (18*a*) in the back direction is directed toward the cooling water inlet side of the intake side of the cooling water jacket (5), a corner (18*b*) facing to the exhaust side is directed toward an end wall at an exhaust inlet side of the exhaust port wall (3*a*), a corner (18*c*) facing to the intake side is directed toward a side wall or lateral wall (1*a*) at the intake side of the cooling water jacket (5), and a forward corner (18*d*) is directed toward an intake port wall side (2*a*).

As shown in FIGS. 3 and 4, cooling water storing recesses (10) are provided. Each of the cooling water storing recesses (10) is placed between the auxiliary combustion chamber wall (4*a*) and the cooling water guide walls (7), (8), (9), (9), and an upper side of the cooling water storing recess (10) is open.

Therefore, engine cooling water (6) stored in the cooling water storing recess (10) receives heat of the auxiliary combustion chamber wall (4*a*), heated and raised, and replaced with engine cooling water (6) existing around the auxiliary combustion chamber wall (4*a*) by convection. Thus, the auxiliary combustion chamber wall (4*a*) is slowly cooled to prevent heat damage of the auxiliary combustion chamber wall (4*a*) caused by abrupt cooling.

Further, the auxiliary combustion chamber wall (4*a*) is slowly cooled and excessive cooling of the auxiliary combustion chamber wall (4*a*) is suppressed, so that it is possible to enhance the heat efficiency of the engine and the starting performance of the engine during a cold period.

In FIGS. 3 and 4, the cooling water storing recess (10) of the downstream cooling water guide wall (8) is superposed on the intake port wall (2*a*), but upper sides of the cooling water storing recess (10) are open on a lower side of the intake port wall (2*a*).

As shown in FIGS. 3 and 4, a thermostat housing (11) is provided. The thermostat housing (11) is formed at a corner portion of a downstream side of the cooling water jacket (5), and has a housing inlet wall (11*a*) on an auxiliary combustion chamber (4) side, the housing inlet wall (11*a*) being inclined such that it approaches the auxiliary combustion chamber (4) as approaching the cooling water jacket (5).

Therefore, engine cooling water (6) guided by the upstream cooling water guide wall (7) smoothly flows into the thermostat housing (11) along the housing inlet wall (11*a*), and flow of the engine cooling water (6) in the cooling water jacket (5) does not back up. Thus, the cooling efficiency of the cylinder head (1) can be enhanced.

The thermostat housing (11) is formed at a discharge side corner portion of the downstream side (front side) of the cooling water jacket (5).

A thermostat (not shown) is accommodated in the thermostat housing (11).

The thermostat housing (11) is integrally molded with the cylinder head (1) by molding.

A cooling water temperature detecting device (16) is placed at a suction side corner portion of the downstream side (front side) of the cooling water jacket (5). The cooling water temperature detecting device (16) is a sensor for detecting temperature of the engine cooling water (6). The cooling water temperature detecting device (16) may be a cooling water temperature switch which energizes an alarm device (not shown) when temperature of the engine cooling water (6) exceeds a predetermined value.

Figure 7:
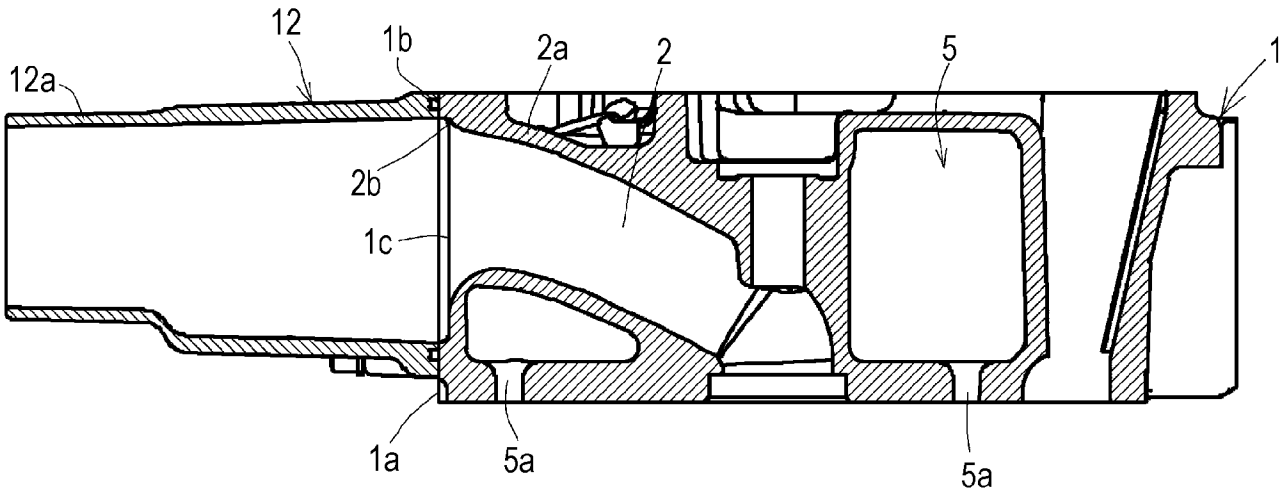
FIG. 7 is a sectional view taken along line VII-VII in FIG. 6.
Figure 8:
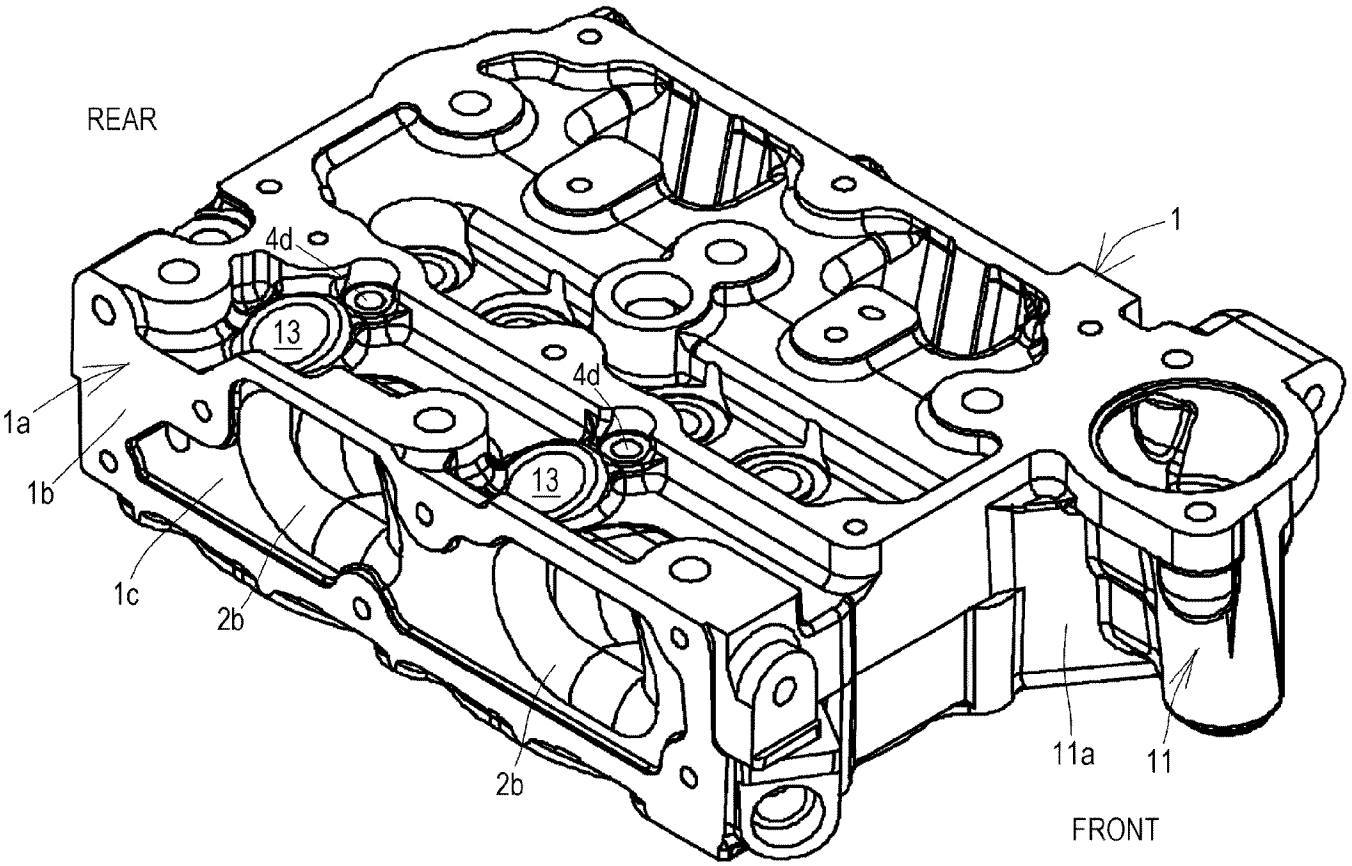
FIG. 8 is a perspective view of the cylinder head shown in FIG. 1.

As shown in FIGS. 6 to 8, the cylinder head (1) includes the intake manifold (12). The intake manifold (12) is a surge tank having no branching tubule, and is formed into a box-shape, and a surface of the box shape facing the cylinder head (1) is entirely open. The lateral wall (1*a*) of the cylinder head (1) has a recess in a portion except a mounting seat (1*b*) of the intake manifold (12). As shown in FIG. 4, intake port inlets (2*b*) formed inside from a recessed end surface (1*c*) of the lateral wall (1*a*) of the cylinder head (1) are formed into funnel-shapes, and the auxiliary combustion chambers (4) are provided on an intake port (2) side of the cylinder head (1).

Therefore, the lateral wall (1*a*) of the cylinder head (1) on the auxiliary combustion chamber (4) side is thinned because of the recess shape and the funnel-shape, heat capacity of the cylinder head (1) on the auxiliary combustion chamber (4) side is reduced, temperature of the auxiliary combustion chamber wall (4*a*) rises early when the engine is started. Thus, it is possible to enhance the starting performance of the engine during a cold period.

Further, intake resistance is reduced, and charging efficiency of intake air can be enhanced.

Furthermore, the capacity of the cylinder head (1) can partially be used as capacity of the surge tank. Correspondingly, it is possible to reduce capacity of the intake manifold (12) and the lateral width of the engine.

Still furthermore, it is possible to avoid inconvenience that the intake port inlet (2*b*) is whittled at the time of polishing processing of the mounting seat (1*b*) of the intake manifold (12) and an edge is formed.

As shown in FIG. 6, an intake inlet pipe (12*a*) of the intake manifold (12) is deviated toward a rear side while avoiding a fuel injection pump (17) which is mounted on a lateral front side of a cylinder block (not shown). The intake manifold (12) is made of synthetic resin.

What is claimed is:

1. A cylinder head cooling apparatus of an engine comprising:

a cylinder head having therein an intake port, an exhaust port, an auxiliary combustion chamber, and a cooling water jacket, in which an intake port wall, an exhaust port wall, and an auxiliary combustion chamber wall are placed in the cooling water jacket, the cooling water jacket includes a cooling water inlet and a cooling water outlet, engine cooling water flowed from the cooling water inlet into the cooling water jacket flows out from the cooling water outlet through the cooling water jacket, a longitudinal direction of the cylinder head aligned with an extending direction of a crankshaft is defined as a front-back direction, and one thereof is front, and another is back, and a width direction of the cylinder head is defined as a right-left direction, and one side of the cylinder head in the right-left direction is an intake side, and another side is an exhaust side, the cooling water outlet of the cooling water jacket is provided at a corner portion of a front side of the cylinder head and at the exhaust side, the cooling water inlet of the exhaust side of the cooling water jacket and the exhaust port wall positioned in front of the cooling water inlet at the exhaust side are disposed at the exhaust side of the cooling water jacket, the auxiliary combustion chamber wall, the cooling water inlet of the intake side of the cooling water jacket positioned behind the auxiliary combustion chamber wall, and the intake port wall positioned at the front side of the auxiliary combustion chamber wall are disposed at the intake side of the cooling water jacket, wherein cooling water guide walls surround the auxiliary combustion chamber wall in a cooling water passing path of the cooling water jacket, and wherein one cooling water guide wall surrounding the auxiliary combustion chamber wall is formed into a shape whose width gradually widens toward a downstream side and another cooling water guide wall surrounding the auxiliary combustion chamber wall is formed into a shape whose width gradually narrows toward the downstream side, and both cooling water guide walls are in contact with the auxiliary combustion chamber wall, wherein both cooling water guide walls are assembled in a quadrilateral form as they surround the auxiliary combustion chamber wall so as to make a quadrilaterally-formed wall, wherein diagonals of a quadrilateral of the quadrilaterally-formed wall are oriented in directions along with the front-back direction and the right-left direction, and, out of the quadrilaterally-formed wall, a backward corner is directed toward the cooling water inlet side of the intake side of the cooling water jacket, a corner facing to the exhaust side is directed toward an end wall at an exhaust inlet side of the exhaust port wall, a corner facing to the intake side is directed toward a side wall at the intake side of the cooling water jacket, and a forward corner is directed toward an intake port wall side.

2. The cylinder head cooling apparatus of an engine according to claim 1, wherein the exhaust port wall is placed on one side of the both-side cooling water guide walls so that the engine cooling water flow is guided by the exhaust port wall.

3. The cylinder head cooling apparatus of an engine according to claim 1, further comprising a cooling water storing recess, wherein the cooling water storing recess is placed between the corner of the quadrilaterally-formed wall and the auxiliary combustion chamber wall, and an upper side of the cooling water storing recess is open.

4. The cylinder head cooling apparatus of an engine according to claim 3, further comprising a thermostat housing, wherein the thermostat housing is formed at a corner portion of the front side of the cylinder head and at the exhaust side, and has a housing inlet wall on an auxiliary combustion chamber side, the housing inlet wall being inclined such that the housing inlet wall approaches the auxiliary combustion chamber as it approaches the cooling water jacket.

5. The cylinder head cooling apparatus of an engine according to claim 1, further comprising a thermostat housing, wherein the thermostat housing is formed at a corner portion of the front side of the cylinder head and at the exhaust side, and has a housing inlet wall on an auxiliary combustion chamber side, the housing inlet wall being inclined such that the housing inlet wall approaches the auxiliary combustion chamber as it approaches the cooling water jacket.

6. The cylinder head cooling apparatus of an engine according to claim 1, further comprising an intake manifold, wherein the intake manifold is a surge tank having no branching tubule, and is formed into a box-shape, a surface of the box-shape facing the cylinder head is entirely open, a lateral wall of the cylinder head has a recess in a portion except a mounting seat of the intake manifold, an intake port inlet formed inside from a recessed end surface of a lateral wall of the cylinder head is formed into a funnel-shape, and the auxiliary combustion chamber is provided on an intake port side of the cylinder head.

* * * * *